United States Patent [19]

Rauch

[11] Patent Number: 4,818,141

[45] Date of Patent: Apr. 4, 1989

[54] PREFABRICATED EROSION PREVENTION WALL

[76] Inventor: Hans G. Rauch, 426 Wayman Cir., West Palm Beach, Fla. 33406

[21] Appl. No.: 873,867

[22] Filed: Jun. 12, 1986

Related U.S. Application Data

[63] Continuation-in-part of Ser. No. 685,747, Dec. 24, 1984, abandoned, which is a continuation of Ser. No. 672,701, Nov. 19, 1984, abandoned.

[51] Int. Cl.[4] ..... E02B 3/06

[52] U.S. Cl. ..... 405/30; 405/21; 405/31

[58] Field of Search ..... 244/114 B; 405/21–35

[56] References Cited

U.S. PATENT DOCUMENTS

| | | | |
|---|---|---|---|
| 805,142 | 11/1905 | Kellner | 405/31 |
| 1,175,962 | 3/1916 | Latham | 405/31 |
| 1,847,043 | 2/1932 | Ball . | |
| 3,037,726 | 6/1962 | Phillips | 244/114 B |
| 3,126,176 | 3/1964 | Lynn | 244/114 B |
| 3,653,216 | 4/1972 | Stickley . | |
| 3,733,831 | 5/1973 | Stickey . | |
| 3,797,787 | 3/1974 | Watanabe | 244/114 B |
| 3,845,630 | 11/1974 | Karnas . | |
| 4,407,608 | 10/1983 | Hubbard | 405/25 X |
| 4,471,924 | 9/1984 | Lynn | 244/114 B |
| 4,498,805 | 2/1985 | Weir | 405/35 X |
| 4,502,816 | 3/1985 | Creter et al. | 405/30 |

FOREIGN PATENT DOCUMENTS

| | | | |
|---|---|---|---|
| 0178510 | 4/1986 | European Pat. Off. | 405/25 |
| 374550 | 4/1923 | Fed. Rep. of Germany | 405/30 |
| 745208 | 2/1933 | France | 405/31 |
| 877057 | 9/1961 | United Kingdom | 405/30 |

*Primary Examiner*—Dennis L. Taylor
*Attorney, Agent, or Firm*—Dale P. DiMaggio

[57] ABSTRACT

Disclosed is a device for protecting against beach erosion. The device has a supporting platform that rests on the sea bottom, and an upwardly curved surface extending from the platform. In one embodiment the concave side faces incoming waves and the convex side faces the seabed. The upwardly curved surface deflects incoming waves upwardly, thus breaking the major portion of their force before they impact upon the beach. The platform and curved surface together form a wall like a barrier that blocks the path of sand washed from the beach, so as to trap the sand for reclaimation before it migrates so far out to seat to be lost irretrievably. The platform can have extending from it anchoring feet to anchor the device in the seabed. In another embodiment the disposition of these convex and concave surfaces is reversed. Incoming waves are broken to a lesser extent, enabling these waves to aid beach buildup by washing submerged sand blocked by the device back onto the beach, much like the known, natural, process by which gentle breaking waves wash up sand trapped in sea grasses.

9 Claims, 5 Drawing Sheets

PREFABRICATED EROSION PREVENTION WALL

This application is a continuation-in-part of application Ser. No. 06/685,747, filed Nov. 24, 1984, now abandoned which in turn is a continuation-in-part of application Ser. No. 06/672,701, filed Nov. 19, 1984 now abandoned.

BACKGROUND OF THE INVENTION

Beach erosion causes great economic damage to resort areas. Whether this damage might occur rapidly during a hurricane, or slowly through the repeated breaking of waves on the beach and the washing of sand out to sea as the waves recede, such erosion is a continuing concern to counties, municipalities, and private organizations that rely heavily for income on the vacation trade. Experience has shown that the major portion of beach erosion results from high breaking waves crashing into the beach. In fact, gentle breaking waves can quite often contribute to the buildup of beach sand when combined with such natural barriers to erosion as sea grass. The grass acts as a filter to trap sand washed off the beach, and gentle incoming waves push the sand trapped in the grass back towards the beach. It is thus manifest that any device that can reduce beach erosion by, for example, deflecting the force of high breaking incoming waves away from the beach, or by blocking the seaward egress of sand soon enough to recover the sand economically, would be of great benefit. Similarly, any device that can not only block the egress of eroded sand, but also can break incoming waves a sufficient amount so that these waves tend to buildup beach sand, rather than erode beach sand, would be of still greater benefit, especially because such a device would reduce the necessity for constantly dredging out eroded beach sand and replacing it on the beach.

SUMMARY OF THE INVENTION

Accordingly, it is an object of this invention to provide a method and break water apparatus effective for absorbing some of the wave energy by causing the waves to break prematurely thereby inhibiting beach erosion.

It is a further object of this invention to provide such a method and apparatus that prevents such erosion by reflecting some of the unabsorbed energy back offshore and transmitting some shoreward thereby reducing the wave energy impinging on the shore.

It is a further object of this invention to provide such a method and apparatus that provides a barrier against seaward migration of beach sand so that this sand can be retrieved economically.

It is a further object of this invention to provide such an apparatus that can be placed permanently on the seabed adjacent the beach.

It is a further object of this invention to provide such an apparatus that is located entirely underwater so as to be inconspicuous, and so as not to provide a hazard to shallow draft boats.

It is a further object of this invention to provide such an apparatus having an above water marker so as not to constitute a hazard to deeper draft boats.

It is a further object of this invention to provide such an apparatus that is simple of construction and inexpensive of manufacture.

It is a further object of this invention to provide such an apparatus that need not be assembled at the beach, but rather can be prefabricated remotely.

It is a further object of this invention to provide such an apparatus that can be easily lifted, placed, or otherwise easily manipulated by, simple grappling hooks.

It is a further object of this invention to provide such an apparatus that prevents such erosion by breaking the force of incoming waves on such a barrier.

It is a further object of this invention to provide such an apparatus that breaks a major portion of the force of incoming waves by chuting such waves up the concave face of an upwardly turned surface.

It is a further object of this invention to provide such an apparatus that breaks a lesser portion of the such waves by chuting such waves over the convex side of an upwardly curved surface.

It is a further object of this invention to provide such an apparatus that can contribute to beach buildup.

In accordance with these and other objects that shall become apparent hereinafter, there is provided a break water barrier apparatus, and a method for using the apparatus so constructed to absorb some of the wave energy, reflect some of the remaining energy back offshore and transmit some shoreward for protecting beaches against erosion. The break water apparatus has a platform that rests on the seabed, i.e. in shallow water adjacent a beach, and has depending therefrom an upwardly curved surface, the concave side of which faces incoming waves, and the convex side which faces the seabed. The concave face of the barrier apparatus serves as a wave guide or chute to reflect incoming waves upwardly and away from the beach. In the preferred embodiments the platform can be a simple planar structure, the surface can be another planar structure curved about a line roughly parallel to the plane in which the platform resides. Because the platform resides roughly horizontally on the seabed, and the curved surface extends generally vertically from the platform, the platform and curved surface together constitute a wall or barrier that serves to block seaward migration of sand away from the beach. Thus eroded sand that accumulates at the barrier could be easily dredged out, dried, and replaced on the beach in a manner sufficiently economical to be of interest to counties, municipalities, private resorts, etc. The platform can also preferably have any manner of anchoring structures to anchor the apparatus on the seabed. Preferably, such anchoring structure takes the form of a simple foot mechanically dependent from the platform which cuts into the seabed.

Please note that in this Specification terms such as "seabed" and the like are used. These terms are chosen to aid disclosure, rather than limit the invention, and use of such terms is not intended to limit the use of the instant invention to, e.g., ocean beaches, salt water beaches, etc. Such terms are used herein generically all bodies of water having beaches, i.e. all places where the instant invention can be of use.

The instant invention will be more fully understood from the following detailed description, it being understood, however, that the invention is capable of extended application, and is not confined to precise disclosure. Changes and modifications may be made that do not affect the spirit of the invention, nor exceed the scope thereof, as expressed in the appended claims. A report is attached and incorporated by reference in this disclosure of patentable subject matter. Accordingly, the instant invention will now be described with particular reference to the accompanying drawings, wherein:

DETAILED DESCRIPTION OF THE PREFERRED EMBODIMENTS

Figure 1A:
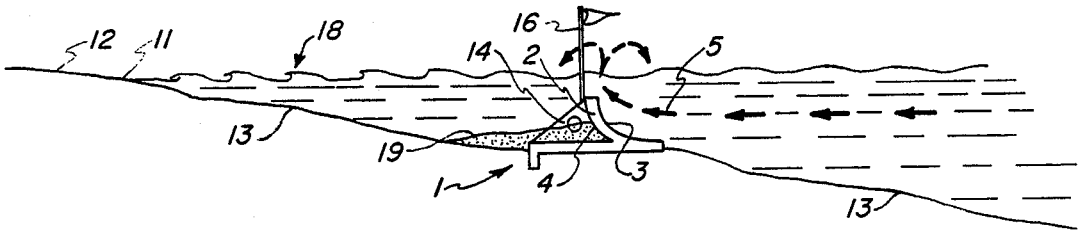
FIG. 1A is an illustration of the underwater placement of the damper or wall.
Figure 2:
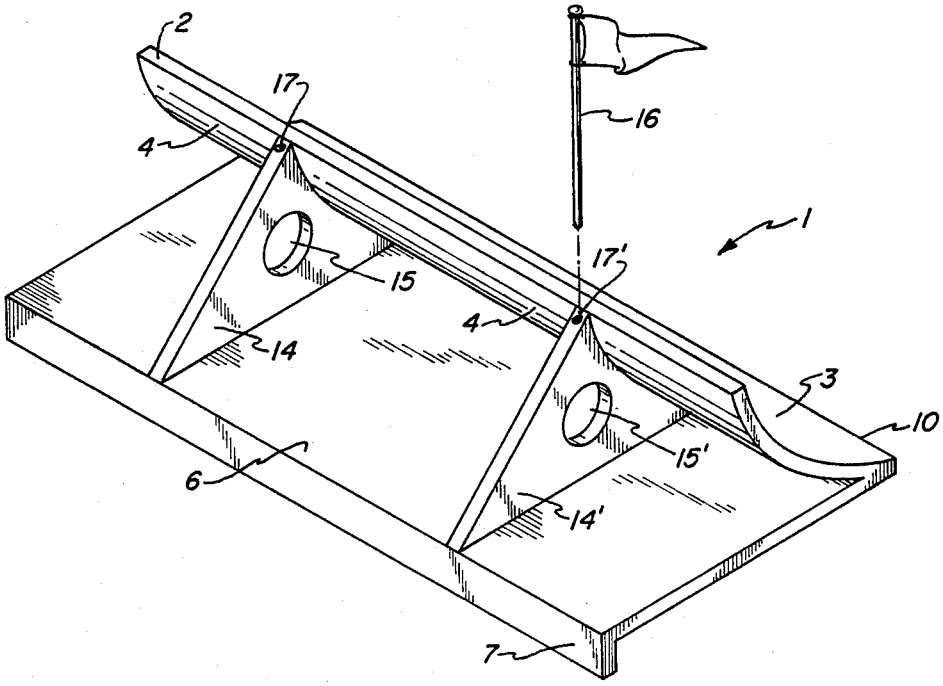
FIG. 2 is an illustration of one underwater placement of the damper or wall.

With reference to the drawing figures, and in particular FIGS. 1A and 2, there is shown a break water device 1 for reducing beach erosion. Device 1 has a generally planar support platform 6 designed to rest on seabed 13 below the still water level, and has depending from it a generally upwardly crescent-shaped curved surface 2. A portion of the perimeter of surface 2, and a portion of support 6, meet and are joined at juncture 10. Surface 2 and support platform 6 can be made integral, or joined together mechanically, in any well known manner. The crescent surface 2 is maintained in spaced relation to platform 6 by struts 14, 14' fixed to the opposite surface 4, curved surface 2 and to the top surface of platform 6. The struts 14, 14' serve to buttress surface 2 against its own weight and the force of incoming waves. Struts 14, 14' includes holes 15, 15', which allow the attachment of grappling hooks so as to aid in the placement, movement, and manipulation of device 1. Struts 14, 14', include a pair of recesses 17, 17' for receiving markers 16. Such markers, e.g. flags that extend above the water's surface, serve to visually identify the location of device 1 so as to ward off boats or people that might be damaged by contact with device 1.

Planar surface 2 has a concave side 3 and a convex side 4. As can be seen from FIG. 1, concave side 3 is located facing incoming waves 5. As waves 5 progress landwardly, that is across a seabed 13 as illustrated in FIG. 1A, the seabed becomes increasingly shallow, and the energy in waves 5 becomes more and more concentrated in a smaller and smaller volume. This volume of high velocity water impinges upon concave side 3 of planar surface 2, and follows the contour of concave side 3 upwardly.

The submerged breakwater structure 1A is constructed as aforesaid to initially absorb some of the wave energy by causing premature breaking of the waves. Some of the remaining wave energy is reflected back offshore and some of the wave energy is transmitted shorewardly thereby considerably reducing the wave energy impinging on the near shore or beach zone.

Thus the energy of breaking waves 5 is directed away from shoreline 11 of beach 12, and shoots upwardly from the top of upwardly crescent curved surface 2. The water immediately adjacent of 1, and, to a lesser extent, shoreward water 18, is thus made turbulent, but the direct impact of waves 5 on shoreline 11, and the inevitable erosion resulting therefrom, is avoided. Crescent-shaped surface 2 can be in the shape of a plane curved about a line parallel to the plane in which resides planar support platform 6, although the exact structural relationships of the components of device 1 will depend on the exact form of any particular beach to be protected, its seabed, its wave intensity and distribution, and frequency of waves breaking on it, etc. One skilled in this art can do this if first made knowledgable of the instant invention. In use, surface 2 is oriented so that the line about which it is bent is generally orthogonal to the direction of incoming waves 5, that is facing waves 5.

As can be seen from FIGS. 1A and 2, device 1 is roughly in the shape of a wall or barrier, curved planar surface 2 constituting the wall and support platform 6 constituting the base supporting the wall. This wall-like configuration is effective to block the seaward migration of sand along seabed 13 towards the open sea so that eroded sand would tend to accumulate on platform 6 abutting convex side 4 of planar surface 2, as shown at 19 in FIG. 1A. Because device 1 normally would be used close to shore, accumulated sand 18 could be easily retrieved by the custodians of beach 12, dried, and replaced on beach 12, all very economically.

Barrier apparatus 1 is preferably formed of a prefabricated, e.g. molded, high density aggregate concrete. The surface of the concrete on immersion below the still water level is continuously wet with resultant penetration of water into the micro cracks existing beween aggregate particles and the cement paste matrix. Thus the concrete wall absorbs water thereby increasing its density and more weight with resultant immovability of the barrier apparatus on the sandy bottom of coastal zones.

The continuously saturated environment of submerged concrete eliminates drying shrinkage and permits long-term crystallization processes to be completed, thus leading to higher strengths. Concrete placed underwater benefits greatly in strength and density.

The prefabricated concrete barrier apparatus permits the wave particles to climb over the curved crescent shaped surface thus preventing wave downrush.

The shape of the curve or arc of the second surface is an essential feature of this invention. The curve is best defined by the angles X and B formed by intersecting imaginary lines 120 and 140 which form an obtuse angle B and imaginary lines 160, 180 which form an acute angle X.

Figure 6:
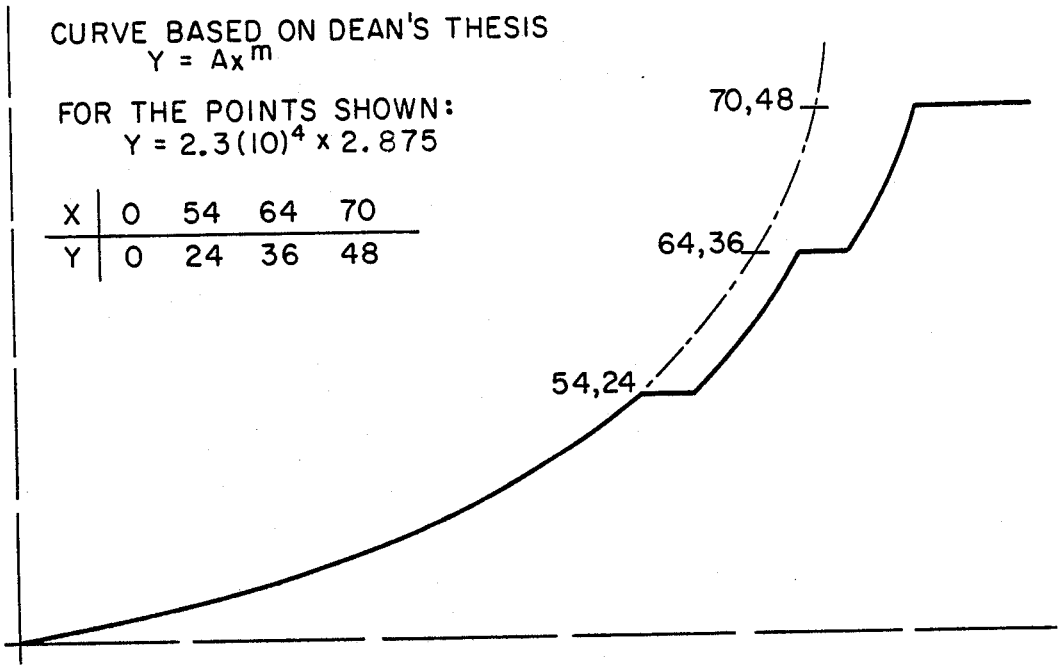
FIG. 6 is a diagrammatical representation illustrating the general curvature of the front, crescent-shaped concave surface of the instant invention.
Figure 7:
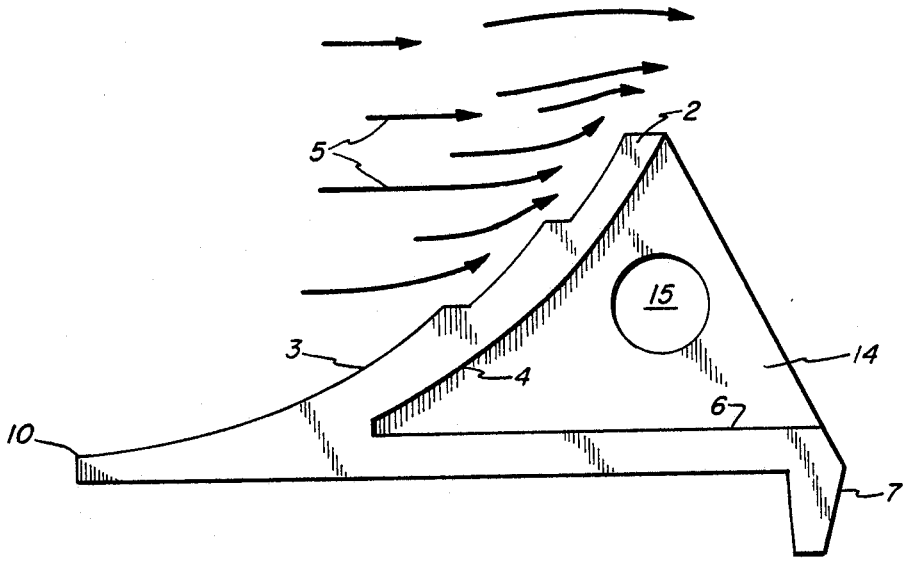
FIG. 7 is a digrammatical representation of the hydro-dynamic flow characteristics of the instant invention.

Referring to FIGS. 6 and 7, it can be seen that the generally crescent-shaped concave front surface has a gradually increasing slope when traversing the front surface from the bottom edge, which is secured to the horizontal platform, to the top, upwardly facing edge. The curved surface can be approximated by the exponential equation $y=Ax^m$. As indicated in FIG. 6, a particular curve is drawn which defines the front surface as $y=2.3(10)\times(2.875)$. The curvature of the concave front surface is extremely important, as the object of the instant invention is to minimize turbulent zones both before and after the reef. The instant invention allows a portion of the wave energy to be transmitted, and yet deflects a relative portion of the wave energy in order to prevent beach erosion. An optimal point must be reached such that the barrier reef does not detrimentally affect the marine habitat, for example the migration patterns of turtles and other aquatic life, nesting grounds, etc. As the reef is an artificial introduction into the ecology, all impediments to the naturally occurring phenomenon must be minimized. This is the critical distinction between the instant invention and the prior art devices, which act as repelling units, create maximum turbulent zones, and would detrimentally affect sea life.

Because of the simplicity and structural solidity of device 1, as well as the ease with which holes 15, 15' permit device 1 to be moved, device 1 can preferably be fabricated remotely and shipped to its purchaser ready for immediate use. This will make installation of device 1 much easier, and make procurment of devices such as 1 much more attractive to beach custodians.

Figure 1B:
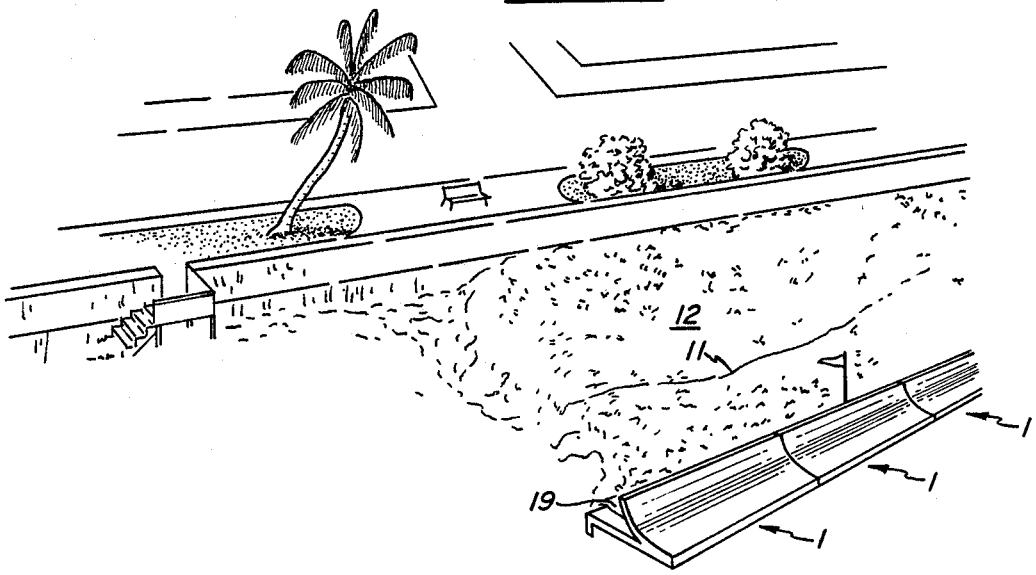
FIG. 1B is an illustration of another underwater placement of the damper or wall.

FIG. 1B illustrates an isometric drawing of a barrier and the sand buildup behind the barrier.

Figure 3A:
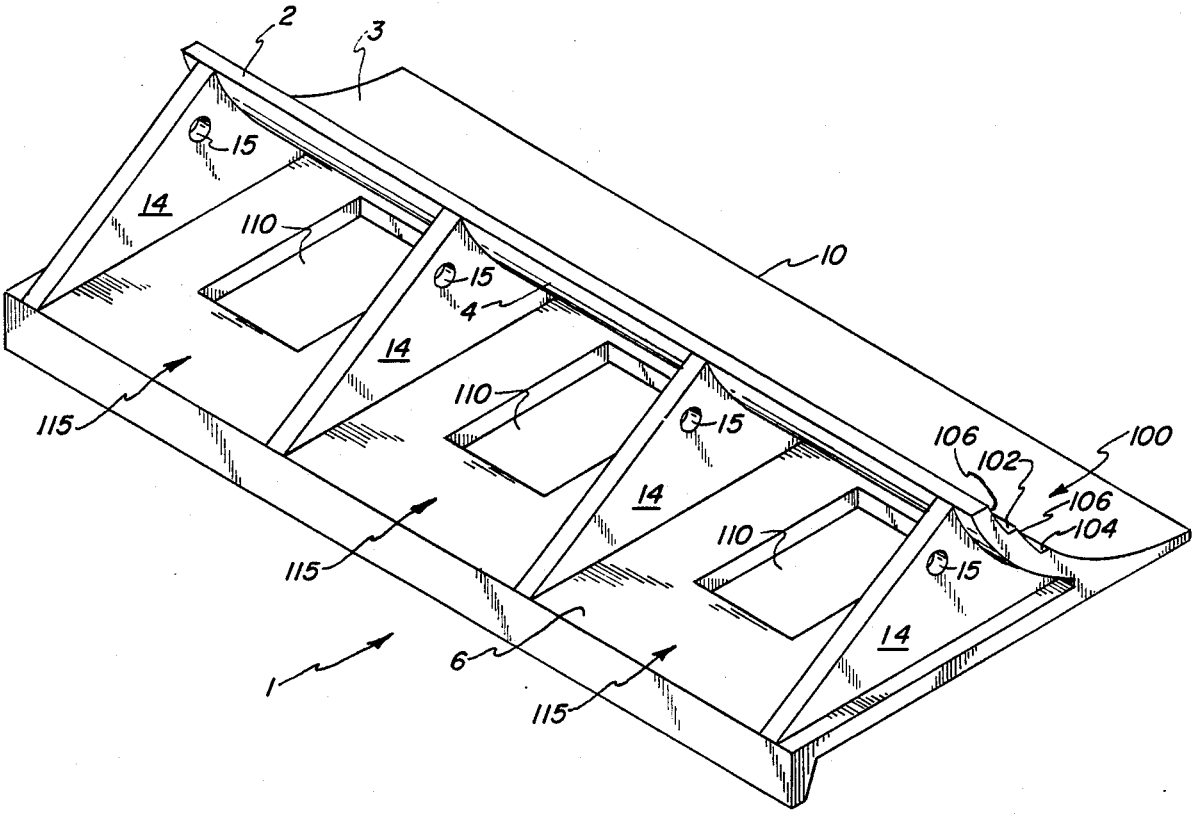
FIG. 3A is an isometric elevational view of one embodiment of a break water barrier apparatus of the instant invention.
Figure 3B:
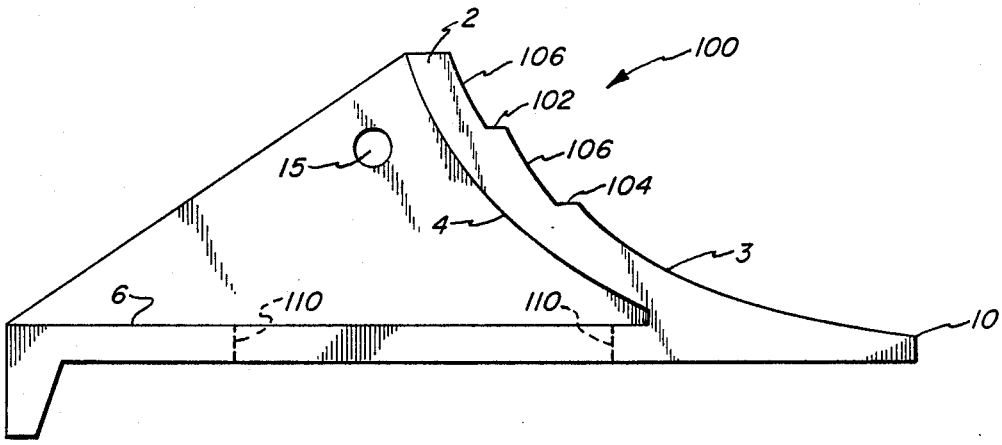
FIG. 3B is a side view of the barrier shown in FIG. 3A.
Figure 4:
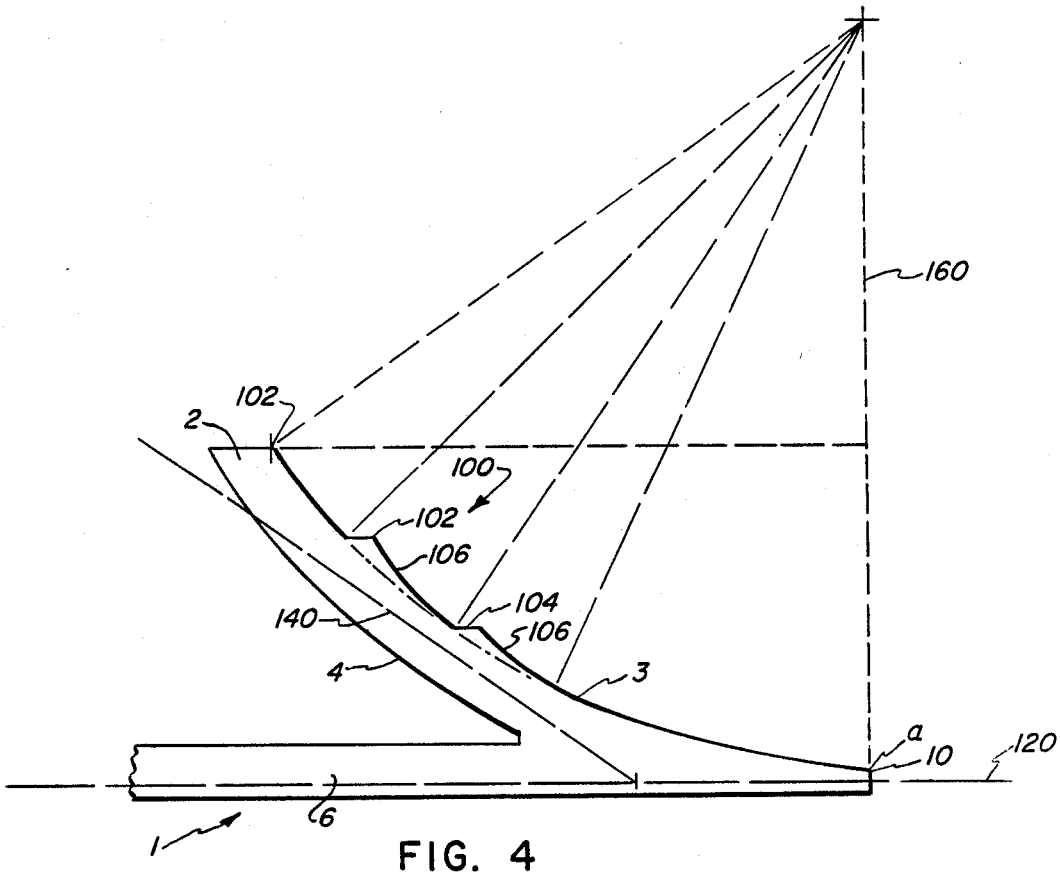
FIG. 4 is a side detailed side view of a barrier.

FIGS. 3A, 3B and 4 illustrate an alternative embodiment of the invention. This embodiment differs from the embodiment shown in FIG. 2 primarily by inclusion of rip-rap projections 100 extending from the curved surface 2 of break water device 1. The first projection 102 constitutes a ledge and extends about 6 inches from a horizontal line parallel with the top 104 of device 1. The second projection 104 also is a ledge and extends about 24 inches or about 2x the distance of projection 102. The berm include risers 106 having opposed ends, one end thereof extending from said ledge and the other end being tangent to the crescent shaped curve of said second surface. Although only two projections are illustrated, more than two may be utilized depending upon the length of the arc of the crescent curve.

The rip-rap projections obviate scouring of the curved surface by protecting the curved surface from the action of water under the waves.

Numerals in FIGS. 3A, 3B and 4 identical to numerals in FIGS. 1A and 2 designate identical features.

The structure 1 includes a hollow interior 115 for accumulation of sand therein which functions as a ballast for substantially maintaining structure 1 in contact with the beach bed. Structure 1 also includes openings 110 permitting accumulated sand to contact the seabed further aiding in maintaining the breakwater device 1 for additionally providing a vertical force for maintaining device 1 in a predetermined location.

Figure 3C:
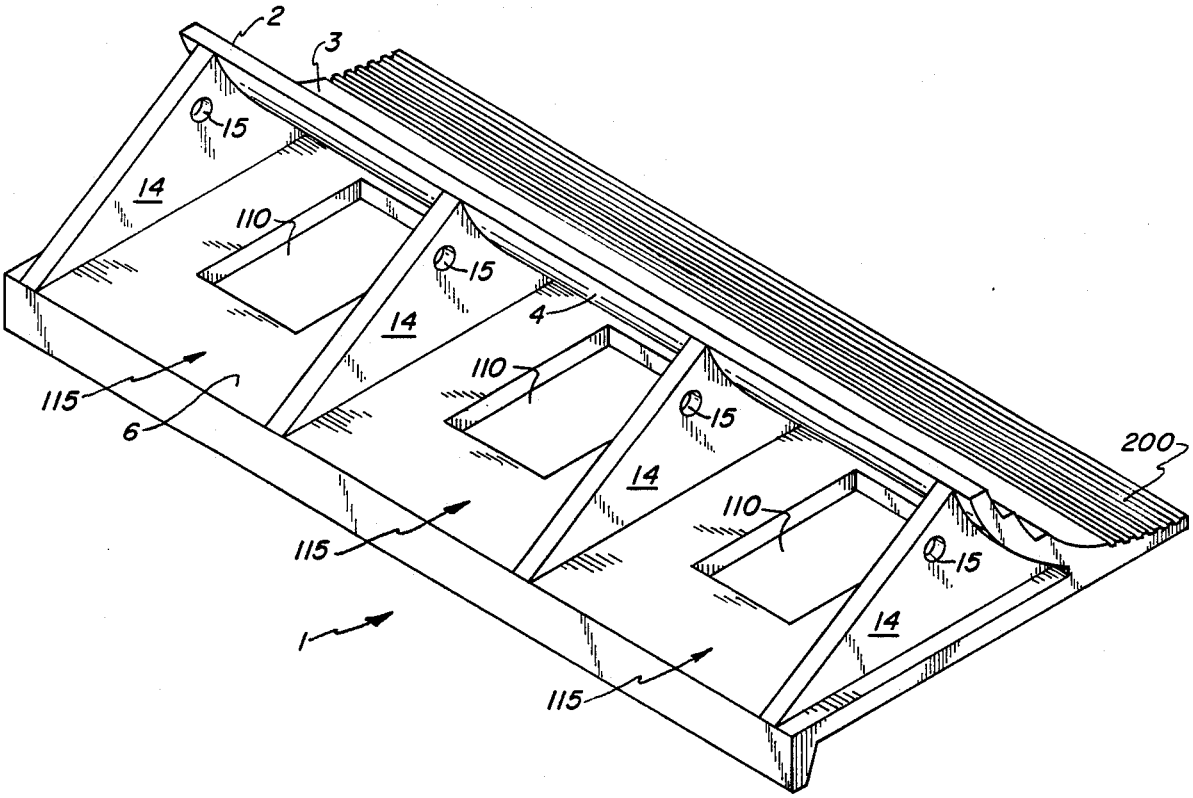
FIG. 3C is an isometric elevation view of a preferred barrier.
Figure 3D:
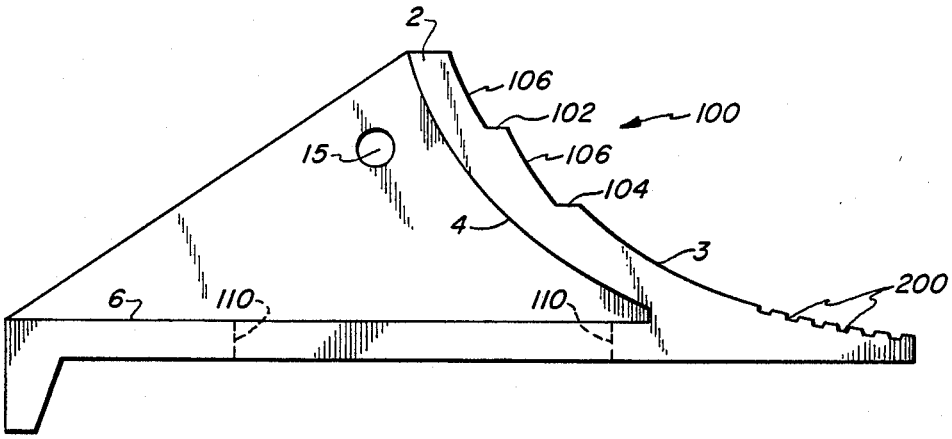
FIG. 3D is a side view of the barrier shown in FIG. 3C.

The preferred embodiment is shown in FIGS. 3C and 3D. The Prefabricated Erosion Prevention Reef or barrier is made of concrete and steel. The barrier has a unibody construction, consisting of a base plate with an ankerbrace, a concave shield and supports. The grade of concrete is generally 6000 psi. Reinforcement is used, generally Rebar #6 is used in a eight inch center spacing, square pattern throughout the whole unit.

The barrier or reef is produced in various sizes, to assure optimal performance at specific sites. Whereby mainly the dimensions of the unit are either increased or decreased proportionately. Unless the degree of wave energy reflection and or dissipation as well as permeability require different performance for desired results.

Steps on the upper section of the shield are for wave energy dissipation. The lower front section of the shield has a grooved at 200 in FIGS. 3C and 3D longitudinal pattern across the full length of the unit. This washboard pattern forms sandpockets to create a cohesive base for the accumulation of sand to prevent scouring in front of the unit. "Cut outs" sections in the base plate help to stabilize the unit in conjunction with the ankerbrace. Stainless-steel eyebolts are poured in the concrete to fasten marker buoys.

Figure 5:
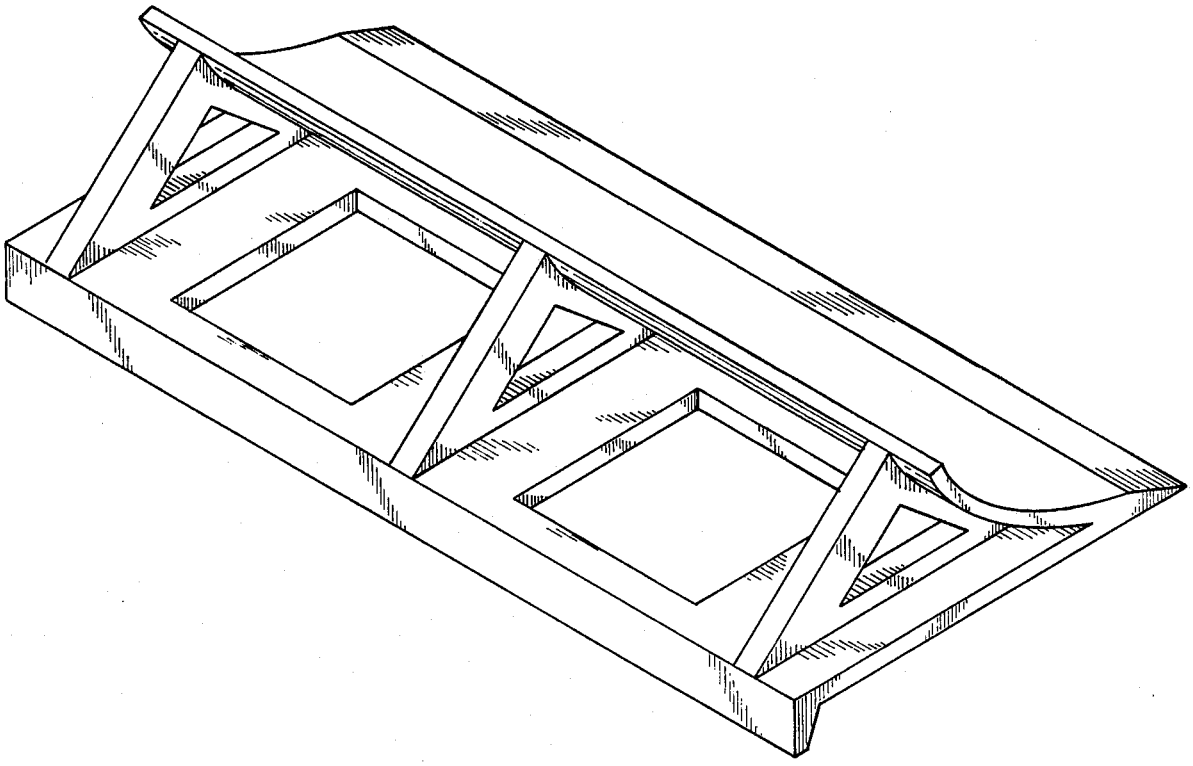
FIG. 5 is another isometric view of an embodiment of a barrier.

FIG. 5 illustrates another embodiment of the invention illustrating differing support structure for the concave side.

The instant invention has been shown and described herein in what is considered to be the most practical and preferred embodiments. However, the preferred embodiments described above are for purposes of illustration rather than limitation. For example, as discussed above, the particular parameters of any embodiment of the invention will necessarily vary from beach to beach. Just as one beach differs from another, the exact parameters of any embodiment of this invention will vary from one beach to another, this being apparent to those skilled in this art, and within their competence to effect once informed of the instant invention. More broadly, it is recognized that departures from the disclosed embodiments may be made within the scope of the invention and that obvious modifications will occur to a person skilled in the art. Accordingly, the scope of the instant invention is to be discerned by reference to the appended claims, wherein:

What is claimed is:

1. A prefabricated erosion prevention barrier, said barrier placed on the seabed beneath surf waters and used to prevent beach erosion, comprising:

a generally horizontal platform, said platform securing said barrier upon said seabed, a generally crescent shaped, concave front surface, said front surface having a seabed bottom edge secured to said platform and an upwardly rising top edge, said front surface facing incoming waves when said barrier is placed upon said seabed, said crescent shape having an increasing slope with respect to said horizontal platform when traversing said front surface from said bottom edge to said top edge, and a plurality of support struts, said struts interposed said concave front surface and said horizontal platform, said struts being generally perpendicular to said surface and platform, wherein an artificial barrier reef is provided which minimizes turbulence both before and after said reef, allows an optimum percentage of wave energy transmission and deflection, and prevents beach erosion without detrimental effects upon natural marine conditions and habitat.

2. The apparatus of claim 1 wherein said crescent shaped, concave front surface is generally exponential when traversing said front surface from said bottom edge to said top edge.

3. The apparatus of claim 2 wherein said generally exponential crescent shaped, concave front surface is defined by the mathematical equation $y=Ax^m$.

4. The apparatus of claim 1 wherein said generally crescent shaped, concave front surface further comprises a series of transverse rip-rap berms.

5. The apparatus of claim 1 wherein said generally crescent shaped, concave front surface further comprises a plurality of curved risers, each said riser providing a ledge upon said front surface, said risers further providing wave energy dissipation.

6. The apparatus of claim 1 wherein said horizontal platform further comprises a generally vertical rear edge member, said rear edge member being generally perpendicular to said horizontal platform and protruding downward therefrom, said protruding rear edge member further anchoring said barrier to said seabed.

7. The apparatus of claim 6 wherein said horizontal platform contains a plurality of voids, said voids selectively allowing the passage of sand and surf water through said platform, further contributing to the stability of said prefabricated erosion prevention barrier.

8. The apparatus of claim 1 further comprising anchoring means, said anchoring means being used to secure said prefabricated erosion prevention barrier to said seabed, and lifting means, said lifting means being utilized in the transportation and placement of said prefabricated erosion prevention barrier upon said seabed and making adjustments thereto.

9. A prefabricated erosion prevention barrier, said barrier placed upon the seabed beneath surf waters and used to prevent beach erosion, comprising:

a generally horizontal platform, said platform securing said barrier upon said seabed, said platform having a generally vertical rear edge member, said rear edge member being generally perpendicular to said horizontal platform and protruding downward therefrom, said protruding rear edge member further anchoring said barrier to said seabed, said horizontal platform including a plurality of voids, said voids selectively allowing the passage of sand and surf water through said platform;

a generally crescent-shaped, concave front surface, said front surface having a seabed bottom edge secured to said platform and an upwardly rising top edge, said front surface facing incoming waves when said barrier is placed upon said seabed, said crescent shape having an increasing slope with respect to said horizontal platform when traversing said front surface from said bottom edge to said top edge, said crescent-shaped being generally exponential and defined by the mathematical equation $Y=Ax^m$, said front surface having a series of transverse rip-rap berms along the lower portion thereon, and said front surface further including a plurality of curved risers, each said riser providing a ledge upon said front surface, said risers being generally located on the upper half of said front surface, said risers further providing wave energy dissipation;

a plurality of support struts, said struts interposed said concave front surface and said horizontal platform, said struts being generally perpendicular to said surface and platform;

said barrier further comprising anchoring means, said anchoring means being used to secure said prefabricated erosion prevention barrier to said seabed, and lifting means, said lifting means being utilized in the transportation and placement of said prefabricated erosion prevention barrier upon said seabed;

wherein an artificial barrier reef is provided which minimizes turbulence both before and after said reef, allows an optimum percentage of wave energy transmission and deflection, and prevents beach erosion without detrimental effects upon natural marine conditions and habitat.

* * * * *